United States Patent [19]

Cheng

[11] Patent Number: 4,594,140

[45] Date of Patent: Jun. 10, 1986

[54] INTEGRATED COAL LIQUEFACTION, GASIFICATION AND ELECTRICITY PRODUCTION PROCESS

[76] Inventor: Shang-I Cheng, 17 Woodsend Dr., Matawan, N.J. 07747

[21] Appl. No.: 596,614

[22] Filed: Apr. 4, 1984

[51] Int. Cl.[4] ..... C10G 1/00

[52] U.S. Cl. ..... 208/414; 208/418; 208/428; 208/431; 252/373; 60/648

[58] Field of Search ..... 208/8 R, 10, 8 LE

[56] References Cited

U.S. PATENT DOCUMENTS

| | | | |
|---|---|---|---|
| 3,715,301 | 2/1973 | Tassoney et al. | 208/8 R |
| 3,894,107 | 7/1975 | Butter et al. | 585/640 |
| 3,944,480 | 3/1976 | Schroeder | 208/8 R |
| 4,035,430 | 7/1977 | Dwyer et al. | 585/322 |
| 4,049,734 | 9/1977 | Garwood et al. | 208/8 R |
| 4,058,576 | 11/1977 | Chang et al. | 585/640 |
| 4,158,637 | 6/1979 | Jones | 208/8 R |
| 4,183,733 | 1/1980 | Jäger | 208/8 R |
| 4,217,201 | 8/1980 | Chervenak | 208/8 R |
| 4,229,185 | 10/1980 | Sass | 208/8 R |
| 4,274,941 | 6/1981 | Janssen et al. | 208/8 R |
| 4,292,048 | 9/1981 | Wesselhoft et al. | 48/202 |
| 4,348,486 | 9/1982 | Calvin et al. | 48/202 |
| 4,353,713 | 10/1982 | Cheng | 48/202 |
| 4,375,402 | 3/1983 | Durai-Swamy | 208/8 R |
| 4,404,083 | 9/1983 | Vasalos | 208/8 R |
| 4,415,431 | 11/1983 | Matyas et al. | 208/8 R |
| 4,435,269 | 3/1984 | Gomory | 208/8 LE |
| 4,447,310 | 5/1984 | Derbyshire et al. | 208/8 LE |

FOREIGN PATENT DOCUMENTS

| | | | |
|---|---|---|---|
| 2912031 | 10/1979 | Fed. Rep. of Germany | 208/8 R |

OTHER PUBLICATIONS

Olsen, *Unit Processes and Principles of Chemical Engineering*, 1932, D. Van Nostrand Co., Inc. TP 155.052, pp. 1–3.

Simbeck et al, "Coal Liquefaction: Direct vs. Indirect–Making a Choice", Oil & Gas Journal, May 4, 1981, pp. 254–268.

Merer and Wood, "Coal Gasification for Industrial Use and Power", Canadian Mining and Metallurgy, Jun. 1978, pp. 71–77.

*Primary Examiner*—John Doll
*Assistant Examiner*—Lance Johnson
*Attorney, Agent, or Firm*—Hoffmann, Dilworth Barrese & Baron

[57] ABSTRACT

Methods for the physical and operational integration of a carbonaceous gasification plan, a gaseous fuel synthesis plant and a power generation station to economincally produce synfuel and electrical power comprising producing gases comprising carbon monoxide and hydrogen from carbonaceous raw materials in a gasification unit wherein the gasification unit utilizes exhaust steam from a power generating unit to provide various energy needs for producing synthesis gas, utilizing the hydrogen derived from the gasification unit in the liquefying and hydrogenation of coal or hydrogenation of natural gas in a fuel synthesis unit wherein the heat generated from the exothermic reactions in the fuel synthesis unit is employed to generate high pressure steam which is fed to a power generation unit to drive electrical power producing turbines wherein the exhaust steam from the turbine is used in the gasification unit as a heat source during gasification and collecting of steam condensate from the exhaust steam and recycling condensate to provide water to the fuel synthesis unit.

6 Claims, 1 Drawing Figure

THE FLOWSHEET OF A GASIFICATION-COAL LIQUEFACTION GENERATION COMPLEX

THE FLOWSHEET OF A GASIFICATION-COAL LIQUEFACTION GENERATION COMPLEX

INTEGRATED COAL LIQUEFACTION, GASIFICATION AND ELECTRICITY PRODUCTION PROCESS

BACKGROUND OF THE INVENTION

This invention relates to the economical production of synfuel and electrical power and more particularly, to a method for the physical and operational integration of a carbonaceous gasification plant, a gas fuel synthesis plant and a power generation station to economically produce synfuel and electrical power.

Synthesis gas, a mixture of hydrogen and carbon monoxide, is conventionally produced by the partial oxidation of carbonaceous material or by the steam reforming of natural gas. Production of synthetic fuels from coal-derived synthesis gas (syngas) or from natural gas and methanol is possible by a variety of methods. These methods involve high costs to derive the raw material gases from, for example, the gasification of coal, and huge capital investment which together present obstacles to economical commercialization of synthetic fuel operations. In order to make the United States energy independent, economically plausible means must be found to synthesize high heating value fuels such as synthetic natural gas, methanol and liquid hydrocarbons.

A need exists for economically advantageous methods and apparatus for producing synthetic fuel (synfuel). It is possible to lower the operation costs of fuel synthesis by utilizing cheaper raw material gases and the inherent energy derived from energy producing (exothermic) operations such as the fuel synthesis in other related or integrated operations.

SUMMARY OF THE INVENTION

It is therefore an object of the present invention to provide a method for the economical production of synfuel. It is a further object of the present invention to provide a process for the simultaneous production of synfuel and electrical power. It is a more particular object of the invention to provide an integrated method for the economical production of synfuel and electrical power whereby energy produced from a component of the fuel synthesis system can be utilized in other processes within the system and to provide an improved manner for disposing of waste heat in the form of low pressure exhaust steam from the turbines of a cogeneration power plant and utilizing such waste heat in an economically beneficial manner.

It is a still further object of the invention to provide an improved process for producing synfuel and electrical power which requires a minimum amount of cooling water.

To achieve the objects in accordance with the purposes of the invention, as embodied and broadly described herein, the invention comprises a method for the physical and operational integration of a carbonaceous gasification plant, a gas fuel synthesis plant, and a power generation station to economically produce synfuel and electric power comprising producing synthesis gas comprising carbon monoxide and hydrogen from carbonaceous raw materials in a gasification unit wherein the gasification unit utilizes exhaust steam from a power generating unit, which steam heat is originally derived from exothermic reactions carried out in an integrated fuel synthesis unit, to provide some of the heat necessary for purifying the synthesis gas. The synthesis gas produced in the gasification unit is supplied to a fuel synthesis unit. At the fuel synthesis unit either coal is liquefied and hydrogenated, or alternatively natural gas is synthesized, utilizing the gases supplied from the gasification unit as a source of hydrogen for the liquefaction and hydrogenation of the coal or the synthesis of the natural gas or to produce synthetic hydrocarbons from these materials under exothermic conditions. Water is provided to the fuel synthesis unit to remove the exothermic heat of reaction therein by generating high pressure steam from the water. The high pressure steam is then passed to a power generation unit. Tail gases from the fuel synthesis unit are continuously purged and fed to the power generation unit where the tail gases are burned to superheat the high pressure steam. The superheated steam fed from the fuel synthesis unit is utilized to drive turbine-generator sets in the power generation unit to provide electricity. The exhaust system leaving the power generating unit is fed to the gasification unit for utilization therein including utilization in at least one of producing $H_2$ and CO from coal; separating $CO_2$ from product gases; purifying synthesis gas; and removing and recovering contaminating soluble material such as ammonia and heavy metals from the carbonaceous raw materials and the effluent streams.

The above described process thus advantageously recovers the heat generated by burning a part of the carbon content of the raw materials fed to the gasification plant and consumed in the exothermic gasification reactions in the coal liquefaction or methane synthesis plant as exothermic reaction heat in the form of high pressure steam. The high pressure steam is then beneficially utilized in the power generation plant, e.g., drive turbine generation sets to produce electricity.

In preferred embodiments, steam utilized in the gasification processes is condensed in the gasification unit, collected, and pumped into the fuel synthesis unit for use in removing the reaction heat by the conversion of water to high pressure steam. Additionally, water gas shift reactions are advantageously carried out in the fuel synthesis unit to increase the supply of hydrogen gas available for the fuel synthesis process.

DETAILED DESCRIPTION OF THE PREFERRED EMBODIMENTS

Figure 1:
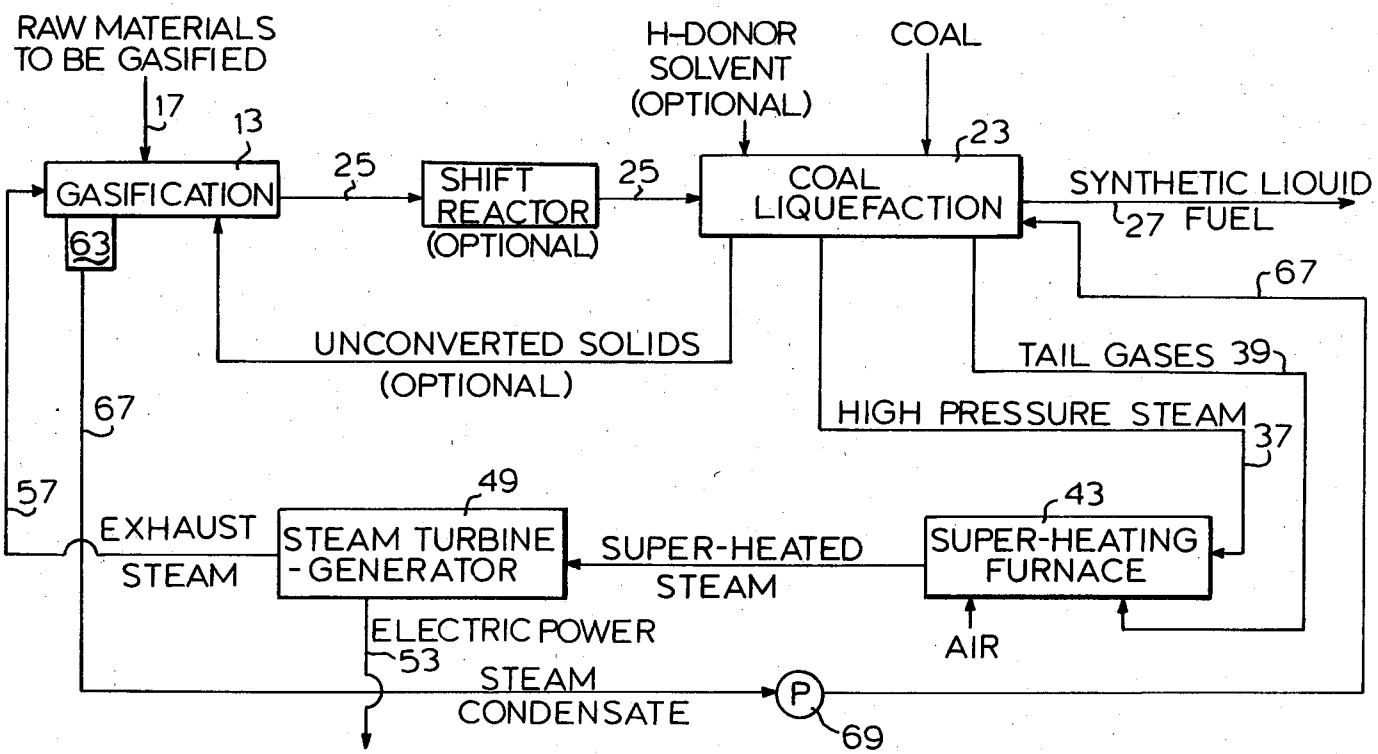
FIG. 1 is a flow sheet of a preferred embodiment of an apparatus complex for implementing the method of the invention.

Reference will now be made in detail to the present preferred embodiments of the method of the invention.

The invention provides a method for the physical and operational integration of a carbonaceous gasification plant, a gas fuel synthesis plant and a power generation station to economically produce synfuel and electrical power. The invention takes advantage of the heat of reaction accompanying the exothermic reactions generated in the synthesis of fuel to be a power source for the creation of steam that can be utilized to drive a power generation station and the exhaust steam from that power generation station can be used in a gasification unit which also requires heat and energy to carry out the gas purifications.

In accordance with the method of the invention, carbon monoxide, hydrogen gases and some low molecular weight hydrocarbons are produced from carbonaceous raw materials in a gasification unit. These gases are generally substantially nitrogen-free. Several commercially available processes such as those developed by Shell, Lurgi, or Texaco exist for deriving Syngas. In addition to these methods any other method for the gasification of coal which is adaptable to the present invention can be used. It is also specifically contemplated to utilize other carbonaceous materials in combination with the coal for gasification such as sludge and other waste materials.

The synthesis fuel production can take place according to any of several known methods such as for the conversion of coal to methanol. Another method would be the indirect liquefaction of coal using fluidized bed (Synthol) or fixed bed (Argre) catalytic reaction to convert a carbon monoxide and hydrogen gas mixture into hydrocarbons, (now in commercial operation) as explained in *Energy Technology Handbook,* Ed. D. M. Considine, McGraw Book Company, 1-285, which reference is incorporated herein by reference. Another method is the direct liquefaction of coal by catalytic hydrogeneration as exemplified by Exxon'donor solvent (EDS) process which is described in *Coal Handbook,* Ed. R. A. Myers, Marcel Dekker, Inc., pp. 735-6, 1981.

It is further contemplated to combine the present invention with the methods disclosed in U.S. Pat. No. 4,353,713 describing previous work of the present inventor. This patent is directed to utilization of heat, produced by the exothermic reaction of CaO and $CO_2$, in a gasification process. The entire disclosure of U.S. Pat. No. 4,353,713 is incorporated herein by reference.

A particularly suitable gasification unit is the Lurgi gasifier which is well known to the art and can generate almost nitrogen-free raw material gases.

It is also contemplated and within the scope of the invention to integrate into the gasification process the suboperations of coal gasification, municipal waste pyrolysis and sludge treatment. The integration of these further operations can contribute to the efficiency and economics of the method of the invention. Great savings can be achieved through the sharing of capital investment in the construction of a gasification unit which also serves to dispose of waste and treat sludge by the sharing of the investment by the various interest groups involved. These would include municipalities interested in the waste and sludge treatment, power companies interested in the production of electrical power and synthetic fuel interests.

In accordance with the method of the invention, coal is liquefied and hydrogenated in a fuel synthesis unit which utilizes gases comprising carbon monoxide and hydrogen supplied from the gasification unit as a source of the hydrogen for the liquefaction and hydrogenation. Instead of coal, natural gas may be used as the synthetic fuel starting material which would also utilize the gases supplied from the gasification unit as a source of hydrogen for the hydrogenation of natural gas to synthetic hydrocarbons useful as fuels.

There are basically three routes for converting coal to liquid hydrocarbons. The synthesizing of hydrocarbons in the fuel synthesis unit can be accomplished by gasifying and liquefying coal to form methanol and then produce gasoline according to a process described in, for example, U.S. Pat. Nos. 3,894,107; 4,035,430; 4,058,576; the entire disclosures of which are incorporated herein by reference. Another route is the indirect liquefication of coal using a fluidized bed (Synthol) or a fixed bed (Arge) catalytic reaction to convert carbon monoxide and hydrogen mixture into hydrocarbons, as referred to supra. Another route is the direct liquefaction of coal by catalytic hydrogenation of coal as exemplified by Exxon's donor solvent (EDS) process.

All the above-mentioned synthetic fuel methods involve exothermic reactions which generate a substantial amount of heat. The heat of reactions involved in the chemical processes of the invention utilized to produce synfuel are illustrated in Table 1. Table 1 illustrates that gasification is the only endothermic reaction which takes place in the operation.

TABLE 1

The Heat of Reactions Involving in Synthesis of Fuels from Coal

| Chemical Reaction | Heat of Reaction, $H_R$, as Function of T (in °K.), calories/grams Mole | $H_R$ at 557° K. (544 ° F.) in calories/grams Mole |
|---|---|---|
| 1. $C + H_2O \rightarrow CO + H_2$ | $31{,}400 + 0.9716(T\text{-}256) - 0.185 \times 10^{-3}(T\text{-}256)^2 - 0.753 \times 10^{8}(T\text{-}256)^3 + 1.392 \times 10^{-12}(T\text{-}256)^4$ | +31,680 |
| 2. $C + O_2 \rightarrow CO_2$ | $-94{,}258 - 9.877 \times 10^{-2}(T\text{-}256) - 5.676 \times 10^{-6}(T\text{-}256)^2 + 1.467 \times 10^{-9}(T\text{-}256)^3$ | −94,289 |
| 3. $C + \frac{1}{2} O_2 \rightarrow CO$ | $-26.349 + 0.330(T\text{-}256) - 0.188 \times 10^{-3}(T\text{-}256)^2 + 0.109 \times 10^{-7}(T\text{-}256)^3$ | −26,232 |
| 4. $CO + H_2O \rightarrow CO_2 + H_2$ | $-10{,}167 + 0.209(T\text{-}256) + 0.190 \times 10^{-3}(T\text{-}256)^2 - 0.292 \times 10^{-7}(T\text{-}256)^3 + 0.139 \times 10^{-11}(T\text{-}256)^4$ | −10,086 |
| 5. $C + 2H_2 \rightarrow CH_4$ | $-17{,}889 - 14.61(T\text{-}298) + 8.712 \times 10^{-3}(T^2\text{-}298^2) - 0.175 \times 10^{-5}(T^3\text{-}298^3)$ | −20,428 |
| 6. $8C + 9H_2 \rightarrow C_8H_{18}$ | $-50{,}317 - 0.48T + T^2 - 0.403 \times 10^{-6}T^3$ | −50,465 |
| 7. $8CH_3OH + H_2 \rightarrow C_8H_{18} + 8H_2O$ | $-15{,}428.5 - 1.15T - 2.09 \times 10^{-2}T^2 + 0.4466 \times 10^{-6}T^3$ | −22,476 |
| 8. $CO + 2H_2 \rightarrow CH_3OH$ | $-21{,}668 - 3.883(T\text{-}298) + 2.72 \times 10^{-2}(T^2\text{-}298^2) + 9.8 \times 10^{-8}(T^3\text{-}298^3)$ | −16,637 |

Optionally, in accordance with the method of the invention an additional step of converting carbon monoxide and water to carbon dioxide and hydrogen gas by a water gas shift reaction can be carried out in a shift reactor within the fuel synthesis unit. Use of a water gas shift reaction is advantageous since hydrogen can be produced from cheaper and readily available carbon monoxide and water thus contributing to the economics of the operation.

Cooling of the synthetic fuel unit is an important consideration when it is considered that most synthetic fuel reactions are operated in temperature ranges of from 400° to 900° F. Economically feasible cooling systems are usually water cooling systems which requires a large cooling water supply and reservoir. The environmental and conservation hazards of such water supplies are well known. It is therefore an additional advantage of the invention to supply recycled cooling water by utilizing cooling water turned to steam to provide power for the electrical generating unit and a heat source for the gasification unit and in turn to condense the steam in the gasification unit for recycling back into the fuel synthesis unit. Steam condensate formed in the gasification unit is collected in steam traps and pumped into cooling compartments in the synthesis unit. The heat transfers and phase changes involving the water used for cooling serve the dual purposes of cooling the exothermic operations with a finite source of cooling water that can be recycled and need not be constantly replenished and providing heat and power for the endothermic operation. It it, however, expected that some outside source of water would be needed to replace that small percentage of water that would be lost through the reaction processes.

The circulating water throughout the reactor system would generate steam with pressures of from about 300 psi to over 3000 psi. Such steam especially when superheated is sufficient to drive turbine generators and power stations.

Additionally, tail gases purged from the fuel synthesis unit are fed to the power generation unit to be burned and supply a heat source of superheat the high pressure steam to more efficiently drive the turbine generator sets. The tail gases may also be combined and burned with added raw material gases derived from the gasification unit.

The exhaust steam from the power generator unit can be used to separate $CO_2$ from the product gases; purify synthesis gas and to remove and recover contaminated soluble material such as ammonia and heavy metals from the carbonaceous raw materials in the effluent streams.

The present invention is further illustrated by an apparatus complex for the economical production of synthetic fuel and electrical power as illustrated in FIG. 1, the apparatus for carrying out the method of the invention is represented generally by the numeral 11.

The apparatus of the invention comprises a gasification unit 13 into which carbonaceous raw materials are fed through an inlet 17. The carbonaceous raw materials are converted to substantially nitrogen-free product gases in a gasification reactor within the gasification unit which is not shown. The gasification reactor may be, for example, a Lurgi gasifier, although any gasifier which can generate the desired gases is suitable in accordance with the invention.

The nitrogen-free product gases from the gasification unit are removed from the gasification unit 13 to the fuel synthesis unit 23 by line 25 for transporting product gas from the gasification unit to the fuel synthesis unit 23.

The fuel synthesis unit also comprises a reactor zone for synthesizing hydrocarbons from the product hydrogen-containing gas from the gasification unit and other raw materials useful for synthesizing hydrocarbons such as coal, methanol, etc. The reaction zone is not shown in FIG. 1. The fuel synthesis unit 23 also has a line 27 for removing the synthesized hydrocarbons, which may then be transported for further processing or storage.

Fuel synthesis unit 23 also comprises line 31 for receiving water into water conduit cooling means (not shown) for cooling the reactor zone and to transfer the heat of the reaction to the water within the cooling zone to create high pressure steam which is removed from the synthesis unit through line 37 and the high pressure steam is transported to burning means i.e. furnace 43.

The synthesis unit also comprises line 41 for removing tail gases from the fuel synthesis unit which are transported along transport means 41 to be burned at burning means 43. The heat from the burning of the tail gases is used to superheat the steam traveling along transport means 37.

The apparatus of the invention also comprises a power generating unit shown as a steam turbine 49 in FIG. 1. The power generating unit comprises an inlet for receiving the superheated steam along transport means 37, the superheated steam is then transported into turbine generator sets 49. The high pressured superheated steam is utilized to drive the turbines within the turbine generator sets (not shown) in order to produce electrical power which is transported from the turbine generator sets through line 53 to be removed from the system for subsequent use. The exhaust steam which has driven the turbines is then removed from the turbine generator sets 49 through line 57 to the gasification unit 13.

The exhaust steam from the power generating unit which enters the gasification unit 13 is then utilized to provide heat energy for the gasification unit's various requirements. The energy required is utilized in processes including at least one of separating $CO_2$ from product gases, purifying synthesis gas, removing and recovering contaminated soluble materials such as ammonia and heavy metals from the carbonaceous raw materials and the effluent stream or as the heat source for gasifying coal and other carbonaceous materials.

After performing its heat supplying functions during any or all of these processes, the exhaust steam is condensed and collects in condensate trap 63. The condensate from condensate trap 63 is removed from the trap through line 67 utilizing a pump 69. The pumped condensate enters the fuel synthesis unit 23 to provide a source of cooling water for cooling means in the synthesis unit 23.

FIG. 1 schematically illustrates the physical and operational integration of a preferred embodiment of the apparatus complex of the invention. A study of FIG. 1 reveals the efficiency and economical advantages of the apparatus of the invention for producing synthetic fuel and electrical power. The heat generated from the synthetic reactions in synthetic fuel unit 23 is utilized to drive the turbine generators in the electrical power generating unit and the exhaust from the steam driven turbines is then used to provide energy for various processes which may take place in gasification unit 13. The apparatus of the invention also serves to conserve cooling water by providing for the recycling of the cooling water from the condensate trap 63 in the gasification unit 13 to be recycled through the synthetic fuel unit and then as steam through the electrical power generating unit and recycled into the gasification unit.

The method of the invention is adaptable to either continuous or batchwise operation. It is important that the methods be adaptable to continuous type operations since these operations are traditionally more economical since less manpower is required to operate the complex and wasteful start up times and cooling down periods are minimized.

Various combinations exist for the method of the invention which are within the scope and contemplation of the invention. These include an integrated gasification unit which would have a combustor, a gasifier and a purifier housed within the unit. The synfuel unit can comprise a shift reactor and reactors for converting coal to methanol and a reactor for converting the methanol to hydrocarbon products which can comprise fuel. The synthetic fuel unit can also comprise a shift reactor for producing carbon dioxide and hydrogen as well as a synthol fluidized bed reactor for producing gas enriched crude oil. The synthetic fuel unit can also include a shift reactor and an Exxon donor solvent synfuel plant reactor system for producing synthetic crudes and residue solids.

The power generating unit would normally include a superheating inlet for superheating the steam flowing from the synthetic fuel unit and a turbine and generator for producing the electrical power.

Further appreciation and understanding of the present invention can be joined by a review of FIGS. 2–4 which illustrate various application and embodiments of the methods of the present invention.

More specific description of a preferred embodiment of the invention is set out in the following example of the method of the invention as carried out in an apparatus complex according to the invention. Appreciation for the apparatus complex and method of the invention can be gained by a review of the example and the example also provides general process parameters for a specific embodiment of the invention.

EXAMPLE

An integrated gasification unit which would form a part of an apparatus complex for the economical production of synthetic fuel and electrical power receives 1200 tons per day of municipal solid waste, 1307 tons per day of Pittsburgh Seam hVAb coal and a 1000 tons per day of sludge with 4% solid content as its raw materials. This raw material input is then converted to synthesis gas which is transported to the synthetic fuel unit.

The synthetic fuel unit comprises a donor solvent liquid fuel synthesis plant. The gas mixture received from the gasification unit would first pass through a water gas shift reactor where substantially all the carbon monoxide gas present would be combined with water for conversion to carbon dioxide and hydrogen. The hydrogen gas would then be fed to liquid fuel synthesis reactors.

Hydrogen gas is combined with coal for direct liquefaction by catalytic hydrogenation. The fuel synthesis reaction is exothermic and requires cooling by water cooling means which transfer the heat from the reaction zone to the water conduits. The water in the water conduits is then changed to steam under high pressure which is then removed from the synthetic fuel unit.

The product hydrocarbons are removed from the synthetic fuel unit as well as residue solvents from the donor solvent synfuel unit.

The steam removed from the synthetic fuel unit is then subjected to superheating by the burning of tail gases or added fuel gases before the steam is transported to the power generating unit. The superheated steam is then directed through the turbine generator sets to produce electrical power. The exhaust steam from the turbine generator sets are then transported to the gasification unit to supply a heat source for the gasification processes. The spent steam which has been condensed is then collected in a condensation trap and recycled to the synthetic fuel unit for use in the water conduit cooling means.

Liquid hydrocarbons are produced at a rate of approximately 16,000 barrels per day in this system. The average reaction temperature within the synthetic fuel unit is about 544° F. and steam is produced to a pressure of up to 1000 pounds per square inch from the synthetic fuel unit. The electrical power generated is estimated to be about 653,000 kilowat hours per day. Heat that is supplied from the tail gases from the synfuel plant when used to superheat the steam will increase the total power generated from the electrical power generating unit and could increase the above estimate substantially.

The method of the invention in view of the above descriptions is seen to provide several advantages and benefits. The integrated complex provides for sharing of equipment between the integrated processes such as the synfuel reactor serving as a steam boiler for producing steam for the power plant thus lowering the level of investment needed for both plants. The integrated operation can also operate with shared personnel. Thus only one crew for each shift is needed for the shared equipment instead of two or three when the plants are operated independently. The method of the invention utilizes cheaper raw material supplies since the gas products from the integrated gas products from the integrated gasification plant can be produced more cheaply than presently known commercial gasification processes. Thus, the availability of cheap gaseous raw material according to the method of the invention solves one of the key problems attributed to the high cost of synfuel manufacturing. The method of the invention results in reduction of overhead since the centralized or coordinated administration of the one power plant versus two separately operated plants would cut back on administrative overhead. The method of the invention also contemplates the recycling of cooling waters and transfer of heat which eliminates the need for large supplies of cooling water from outside sources and avoids the dangers of thermal and water pollution.

Other advantages are apparent from the invention such as the use of low pressure steam exhausted from the power generating turbine to be used in the integration gasification plant for additional process applications such as the evaporation of extracts of solid residue and soluble salts, such as potassium salt. Optionally, when a donor solvent system is used, the invention also provides for the recycling of the residue solids back into the gasification plant for use as raw materials for the production of product gases.

The scope of the present invention is not limited by the description, example and suggested uses herein, and modifications can be made without departing from the spirit of the invention. For example, since the water gas shift reaction is highly exothermic waste heat from this reactor can also be transferred to the water cooling system to generate additional steam for power generation. Thus, it is intended that the present invention cover the modifications and variations of this invention provided they come within the scope of the appended claims and their equivalents.

What is claimed is:

1. A method for the physical and operational integration of a carbonaceous gasification plant, a gas fuel synthesis plant and a power generation station to economically produce synfuel and electric power comprising:

(a) producing synthesis gas comprising carbon monoxide and hydrogen from carbonaceous raw materials in a gasification unit under endothermic reaction conditions wherein the gasification unit utilizes exhaust steam from step (f) effective to provide at least a portion of the endothermic heat of reaction necessary for the reaction and wherein said gas from the gasification unit is passed to a coal liquefaction stage;

(b) liquefying and hydrogenating coal under exothermic reaction conditions with said synthesis gas from said gasification unit as a source of hydrogen thereby producing a synthetic hydrocarbonaceous fuel and tail gases;

(c) providing water to said liquefaction stage in an indirect heat exchange relationship to remove at least a portion of the exothermic heat of reaction from said coal liquefaction stage by generating high pressure steam from said water and passing said high pressure steam to a power generation unit;

(d) continuously purging the tail gases from said liquefaction stage, feeding said tail gases to said power generation unit and burning said tail gases with or without additional fuel sources to superheat said high pressure steam;

(e) passing said superheated steam to a turbine-generator means within said power generating unit to produce electricity and exhaust steam; and (f) feeding at least a portion of said exhaust steam from said power generating unit to said gasification unit .

2. The method of claim 1 comprising the additional step of passing said gas from said gasification unit to a shift reactor prior to passing said gas to said coal liquefaction stage to convert CO and $H_2O$ to $CO_2$ and $H_2$ by a water gas shift reaction.

3. The method of claim 1 wherein the tail gases are burned with added raw material gases derived from said gasification unit or said coal liquefaction stage.

4. The method of claim 1 wherein the gasification unit is a Lurgi gasifier for producing substantially nitrogen free gases.

5. The method of claim 1 wherein the coal liquefaction is carried out in the presence of a hydrogen-donor-solvent and unconverted solid residues from said coal liquefaction stage are fed to said gasification unit.

6. The method of claim 1 wherein the water provided in step (c) to said coal liquefaction stage comprises steam condensate from the exhaust steam utilized in step (a) by the gasification unit.

* * * * *